US006986513B1

(12) United States Patent
Ferrante

(10) Patent No.: US 6,986,513 B1
(45) Date of Patent: Jan. 17, 2006

(54) BOARD GAME FOR FORMING WORDS

(76) Inventor: John A. Ferrante, 880 Oleander Way South, St. Petersburg, FL (US) 33707

( * ) Notice: Subject to any disclaimer, the term of this patent is extended or adjusted under 35 U.S.C. 154(b) by 144 days.

(21) Appl. No.: 10/707,153

(22) Filed: Nov. 24, 2003

(51) Int. Cl.
*A63F 3/00* (2006.01)

(52) U.S. Cl. ..... 273/272; 273/243

(58) Field of Classification Search ..... 434/167, 434/171, 172; 273/272, 299, 243
See application file for complete search history.

(56) References Cited

U.S. PATENT DOCUMENTS 4,306,724 A * 12/1981 Brzezinski et al. ..... 273/243
4,900,031 A * 2/1990 Wohl ..... 273/243
5,273,431 A * 12/1993 Charouhas ..... 434/129
5,547,199 A * 8/1996 Calhoun ..... 273/299
5,906,492 A * 5/1999 Putterman ..... 434/169
6,367,798 B1 * 4/2002 Lawal ..... 273/272

* cited by examiner

*Primary Examiner*—William M. Pierce
(74) *Attorney, Agent, or Firm*—Smith & Hopen P.A.; Ronald E. Smith

(57) ABSTRACT

A board game where the winner is the first to form a ten character word. To speed play, a round ends and points are awarded for formation of an eight or nine character word. If no player wins in a preselected number of rounds, the highest point total wins. Play begins with game pieces following a set-up walk until five characters are accumulated, at which time a player is awarded a spot on a final walk. Landing on a "V," "C," or "Ideation" square enables a player to acquire a vowel, a consonant, or to follow instructions on a card drawn from a stack of Ideation cards, respectively. If a player is required to move backwards on any move, and if that player's game piece lands on a vowel, consonant, or choice of vowel or consonant square, that player must discard a vowel or consonant or either one, respectively.

18 Claims, 5 Drawing Sheets

FIG. 8
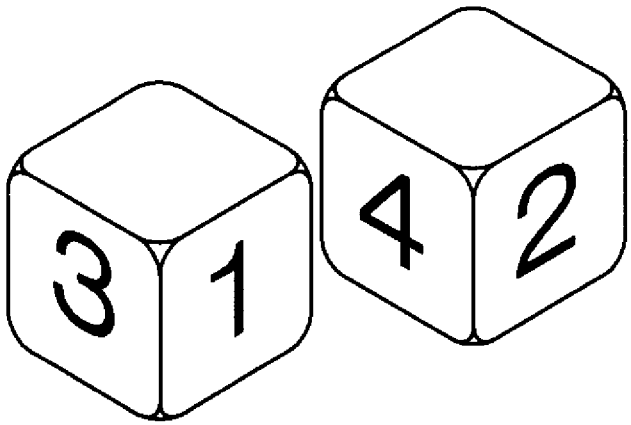
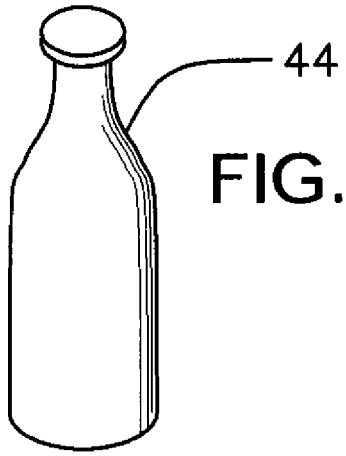
FIG. 9

BOARD GAME FOR FORMING WORDS

BACKGROUND OF INVENTION

1. Field of the Invention

This invention relates, generally, to board games. More particularly, it relates to a board game where the players attempt to form words from vowels and consonants that are randomly selected by moving game pieces on a board or otherwise acquired by drawing cards or by trading with other players of the game.

2. Description of the Prior Art

Board games are known where players are randomly awarded vowels or consonants, hereinafter also referred to as characters, and where the winner is the first to form a word.

Perhaps the most common drawback to board games involving word formation is that such games typically have complex rules and thus are difficult to understand and play.

A need therefore exists for a word formation board game where the rules are easy to understand and the game is easy to play.

Some well-known word formation board games take a long time to play.

Thus there is a need for a word formation board game that can be played in a relatively short time.

Moreover, sometimes a player can win such games even if that player uses a limited vocabulary but is lucky in hitting positions that double or triple the value of a character or of an entire word.

A need therefore exists for a board game that does not rely on a lucky physical location of a word on a game board to enhance the value of a word.

There are also times in such games where all of the players are unable to form any further words, and play must stop.

Thus there is a need for a game that can be divided into rounds so that when no player is able to win a game, points can be allotted for formation of relatively short words so that a winner can be declared after the playing of a few such rounds.

Another drawback of many known board games is that a running score must be recorded for each word formed. Then, at the end of play, the scores must be totaled to determine who won the game.

A need therefore exists for a game where a score need not be recorded after each player has formed a word. More particularly, there is a need for a game where only a single score is recorded at the end of a round where no player was able to win the game. Thus, if a player wins the game, there is no need to record any score. If a player forms a word that qualifies as a round-ending word, then points are totaled for that player only when the round ends.

Some of the known games are also difficult to adapt for young players of limited vocabulary and are equally difficult to adapt for advanced players who command large vocabularies.

A need therefore exists for a game that is easy to adapt to young players and equally easy to adapt to very advanced players with a large vocabulary.

Some of the earlier board games also require each player to maintain his or her collection of characters in secrecy from the other players.

Thus there is a need for a board game where the characters possessed by each player are visible to all other players of the game.

A further need exists for a game where opposing players can take a character from each other to thwart an opponent from forming a word.

There is also a need for a game where strategic trades of characters may be made among the players of the game.

However, in view of the prior art considered as a whole at the time the present invention was made, it was not obvious to those of ordinary skill in the pertinent art how such needs could be fulfilled in a board game that is easy to understand and play.

SUMMARY OF INVENTION

The long-standing but heretofore unfulfilled need for an improved word-formation board game is now met by a new, useful, and nonobvious invention.

The steps of the novel method for playing the board game include the steps of providing a first track, hereinafter referred to as the set-up walk, defining a first path of travel along which respective game pieces controlled by players of the board game advance. The set-up walk includes a plurality of squares where a first plurality of squares represents vowels and a second plurality of squares represents consonants. A player acquires a vowel when that player's game piece arrives at the end of a move on a square in the set-up walk representing a vowel. A player acquires a consonant when the player's game piece arrives at the end of a move on a square in the set-up walk representing a consonant.

More particularly, a player landing on a vowel square draws a vowel card from a stack of vowel cards and a player landing on a consonant square draws a consonant from a stack of consonant cards. Each player is provided with a relatively rigid support surface, hereafter referred to as a wordgram, that is divided into a plurality of spaces each of which is adapted to support a vowel card or a consonant card. As each vowel card or consonant card is acquired by a player, the player positions the card on his or her wordgram with the vowel or consonant face up so that other players can see said vowels and consonants.

The set-up walk also includes a plurality of squares that are neither vowel nor consonant squares. These squares are known as Ideation squares (from which the commercial name of the game is taken). A player whose game piece lands on such a square must pick an Ideation card from a stack of Ideation cards and follow the instructions thereon.

All players begin play from a designated Start square that forms a part of the set-up walk. Upon acquiring a predetermined number of characters, each player leaves the set-up walk.

A second track, hereinafter referred to as the final walk, defines a second path of travel along which the respective game pieces advance after leaving the set-up walk. The final walk is constructed of a plurality of squares where a first plurality of squares represents vowels and a second plurality of squares represents consonants. A player acquires a vowel (in the form of a vowel card, as when traveling through the set-up walk) when the player's game piece arrives at the end of a move on a square representing a vowel and the player acquires a consonant (in the form of a consonant card) when the player's game piece arrives at the end of a move on a square representing a consonant.

The final walk further includes a plurality of Choice of Vowel or Consonant squares. A player whose game piece lands upon such a square may draw a vowel card from the stack of vowel cards or a consonant card from the stack of consonant cards at his or her election.

As in the set-up walk, each vowel card or consonant card acquired on the final walk is placed on a player's wordgram face side up, i.e., with the vowel or consonant visible to the other players.

Moreover, the final walk also includes a plurality of Ideation squares and a player whose game piece lands thereupon must draw an Ideation card and follow its instructions.

The final walk also includes a plurality of squares, known as Personal Color Squares, each of which represents a separate starting point and is identified as associated with a particular game piece by color-coding. Upon jumping from the set-up walk upon the acquisition of a predetermined number of characters, each player begins play on the final walk at the Personal Color Square associated with that player's game piece.

The final walk is discontinuous from the set-up walk.

In a preferred embodiment, the game piece of a player exits the set-up walk and enters the final walk at a starting point on the final walk associated with that player's game piece when the player has accumulated five (5) vowels, consonants, or combinations thereof while advancing along the set-up walk.

The game ends when a player forms a word consisting of a first predetermined number of vowels and consonants.

In the event none of the players can form a word having a sufficient number of vowels and consonants to win the game, the game is divided into a predetermined number of rounds. A round ends when a player forms a word including a second predetermined number of consonants and vowels less than the first predetermined number thereof required to win the game. The player forming a word including the second predetermined number of vowels and consonants is awarded a first predetermined number of points.

When a player wins a round by announcing the formation of a word having the second number of predetermined consonants or vowels, the remaining players attempt to form words with the vowel and consonant cards on their wordgram at the time of the round-ending announcement. Characters remaining on the wordgram of a non-winning player that do not form part of a word of predetermined length are deemed to be "abandoned" characters and the winner of the round is awarded a point for each abandoned character on each of the opponent's wordgrams. However, characters on the round-winner's wordgram that are not used by the round-winner are deducted from the round-winner's total.

In the preferred embodiment of this invention, an "abandoned" vowel or consonant is a vowel or consonant on a player's wordgram that does not form a part of a five (5), six (6), or seven (7) letter word, (for non-round-winners) or an eight (8) or nine (9) letter word (for the round-winner).

However, as mentioned earlier, the number of characters required to form a word may be lowered for children's versions of the game or increased for advanced players. Accordingly, the number of characters required to form round-ending words, as distinguished from game-ending words, may be varied at will. Similarly, the number of characters required to be in a word formed by the non-winning players at the end of a round to avoid abandonment of the characters in said word may also be increased or decreased depending upon whether the game is being played by children or advanced players.

If no player can form a word having said second predetermined number of vowels and consonants, a round ends when a player forms a word including a third predetermined number of consonants and vowels less than the second predetermined number thereof. A player forming the third predetermined number of vowels and consonants is awarded a second predetermined number of points less than the first predetermined number of points.

The player who forms a word including the second predetermined of vowels and consonants is further awarded a point for each "abandoned" vowel or consonant remaining in the possession of each opponent at the time the word including the second predetermined number of vowels and consonants was formed.

The player who forms a word including the third predetermined of vowels and consonants is further awarded a point for each abandoned vowel or consonant remaining in the possession of each opponent at the time the word including the third predetermined number of vowels and consonants was formed.

The number of rounds in each game is preferably limited to the number of players of the game.

The total number of vowel and consonant cards that each player may position atop his or her wordgram is limited to a predetermined number. A player having a total number of vowel and consonant cards on a wordgram that exceeds the predetermined number is penalized. The penalized player is required to discard a predetermined number of cards from the wordgram used by the penalized player. The penalized player is further penalized by requiring said penalized player to lose one turn.

A dictionary is pre-approved prior to the playing of the game and is consulted in the event the authenticity of a word is challenged during a game. Each player may challenge the authenticity of a word submitted by any other player as a game or round-winning word by demonstrating that the word is either not found in the pre-approved dictionary or, if found, that the word is misspelled.

A player who submits a game or round-winning word that is successfully challenged as lacking authenticity is required to remove a predetermined number of cards from that player's wordgram. The player also loses one turn.

A player whose game piece lands on a square on the final walk that is associated with the game piece of another player is also penalized by requiring that player to lose a vowel or a consonant in the possession of the penalized player to the player with whom the square is associated. Moreover, the player with whom the square is associated may choose which of the vowels or consonants in the possession of the penalized player is to be acquired.

Further rules regulate how characters are traded, how a turn may be lost by means other than those summarized herein, and the like.

An important object of this invention is to provide a board game for forming words where the rules are easy to understand and the game is easy to play.

Another important object is to provide a board game that can be played in a relatively short time.

Another object is to provide a board game that does not rely on a lucky physical location of a word on a game board to enhance the value of a word.

Another object is to provide a board game that can be divided into rounds so that when no player is able to win the game, points can be allotted for formation of relatively short words so that a winner can be declared after the playing of a few such rounds.

Still another object is to provide a board game where only one score is recorded at the end of a round where no player was able to win the game. If a player wins the game, there is no need to record any score.

Another object is to provide a board game that is easy to adapt to young players and equally easy to adapt to very advanced players having a large vocabulary.

Another object is to provide a board game where the characters possessed by each player are visible to all other players of the game.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which:

FIG. 8 is a perspective view of the novel dice; and

FIG. 9 is a perspective view of a game piece.

DETAILED DESCRIPTION

Figure 1:
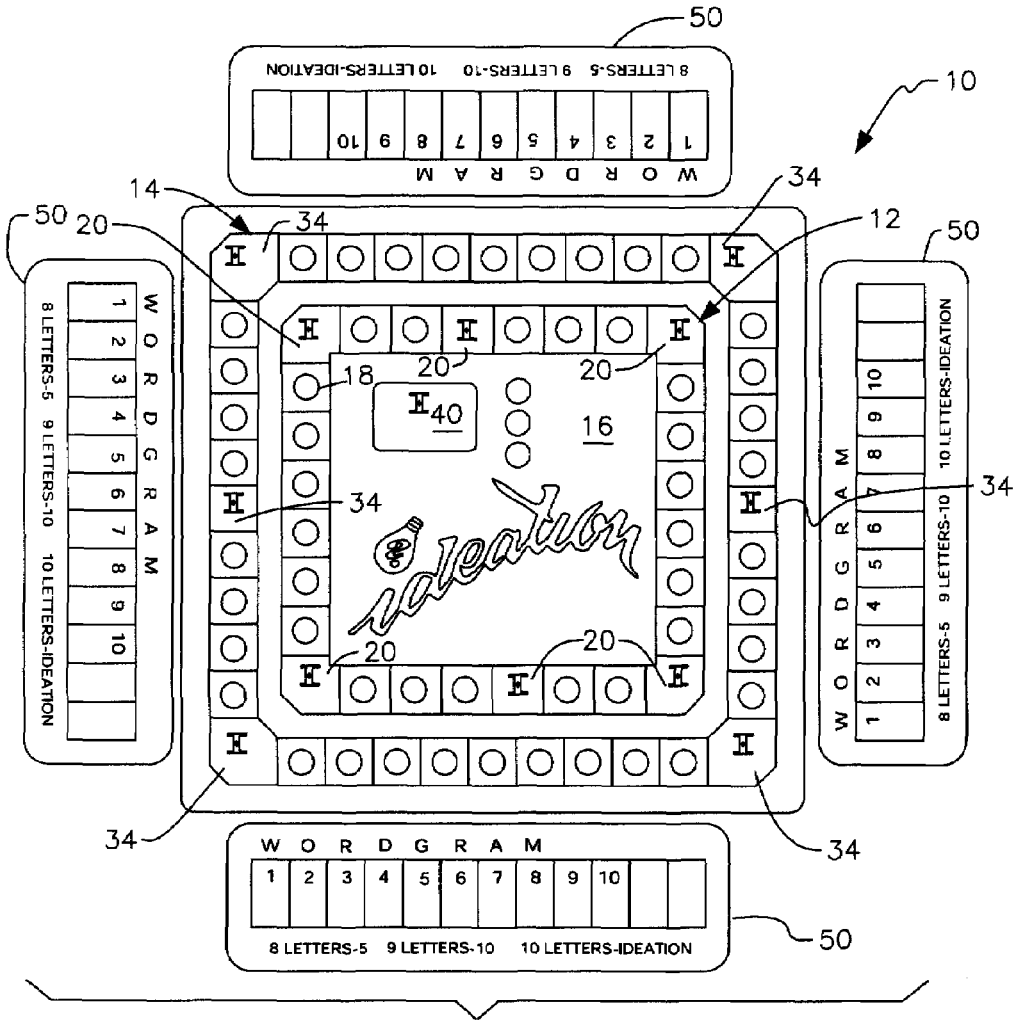
FIG. 1 is a top plan view of the novel game board and the novel word formation boards when the game is set up for four (4) players.

Referring to FIG. 1, it will there be seen that the reference numeral 10 denotes an illustrative embodiment of the present invention as a whole.

Board game 10 includes in inner track 12, also known as a "set-up walk," an outer track 14, also known as a "final walk," and a center area 16.

As best depicted in FIGS. 2, 3, 4, and 5, set-up walk 12 includes a "Start" square 18, a plurality of "Ideation" squares, collectively denoted 20, a plurality of "V" squares, collectively denoted 22, and a plurality of "C" squares, collectively denoted 24. Start square 18 is also a vowel square 22.

Play begins with all game pieces positioned at said "Start" square on the set-up walk.

Final walk 14 includes four (4) color-coded "Start" squares, all of which are used in a four (4) player game, any three (3) of which are used in a three (3) player game, and any two (2) of which are used in a two (2) player game.

Although any colors may be used, in this particular embodiment "Start" square 26 (FIG. 2) is red in color and has a yellow marker 26*a* in the center thereof. "Start" square 28 (FIG. 3) is blue in color and has a yellow marker 28*a* in the center thereof. "Start" square 30 (FIG. 4) is green in color and has a marker 30*a* in the center thereof. Start" square 32 (FIG. 5) is yellow in color and also has a yellow marker 32*a* of a different shade of yellow positioned centrally thereof.

The notation "PCS" on each of said yellow markers is an acronym for Personal Color Square. Thus, a player who has selected a red playing piece, upon advancing from set-up walk 12 to final walk 14, begins at "Start" square 26 because said red square is that player's Personal Color Square.

Figure 5:
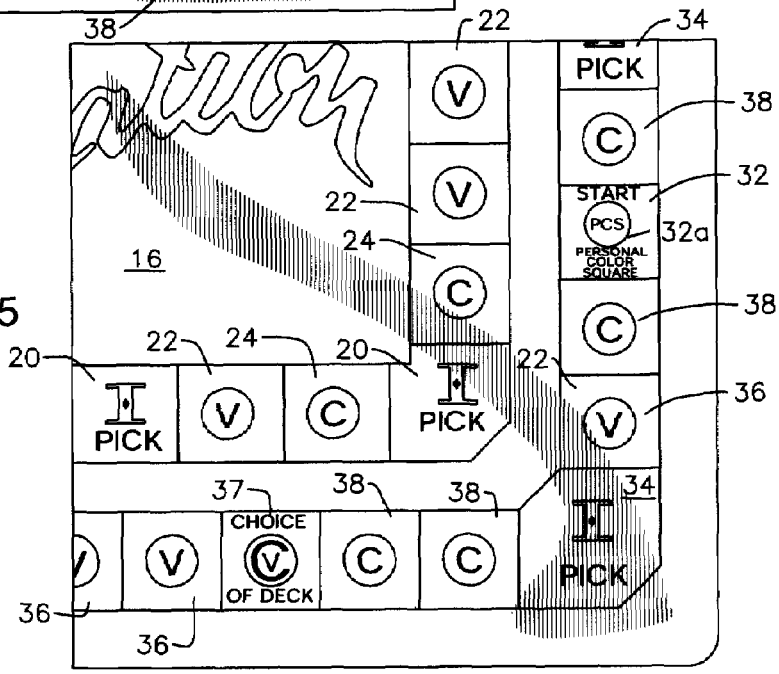
FIG. 5 is a detailed view of the lower right corner of the novel game board.

Final walk 14, like set-up walk 12, also includes, a plurality of "Ideation" squares, collectively denoted 34, a plurality of "V" squares, collectively denoted 36, and a plurality of "C" squares, collectively denoted 38. Unlike set-up walk 12, final walk 14 further includes at least one "Choice of Vowel or Consonant" square. In this example, two of such squares are provided and are collectively denoted 37 (FIGS. 2 and 5).

Figure 2:
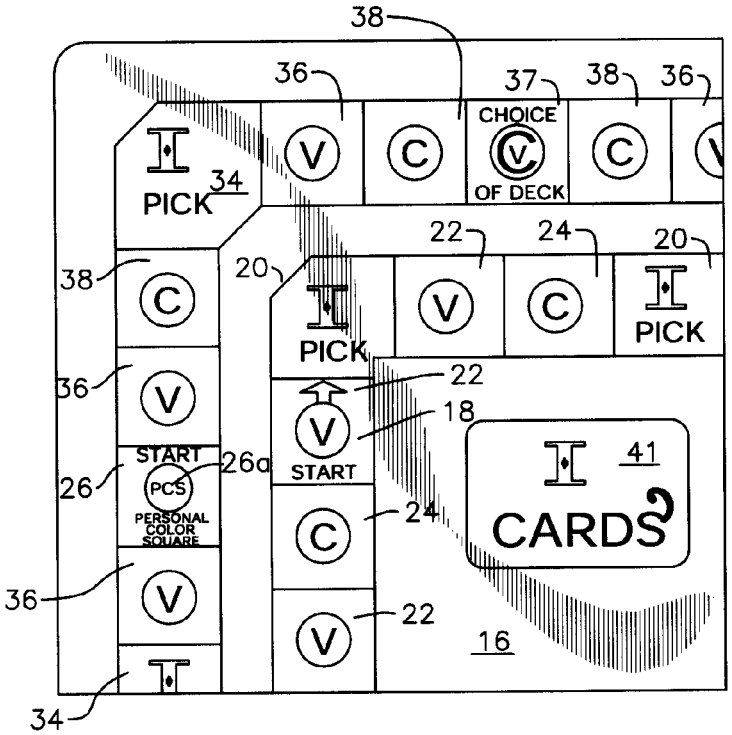
FIG. 2 is a detailed view of the upper left corner of the novel game board.
Figure 3:
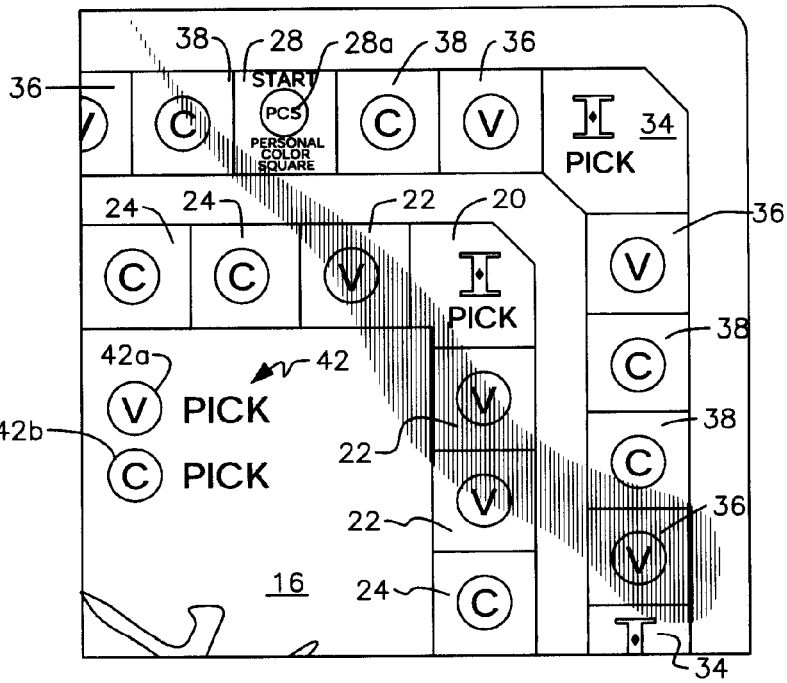
FIG. 3 is a detailed view of the upper right corner of the novel game board.
Figure 4:
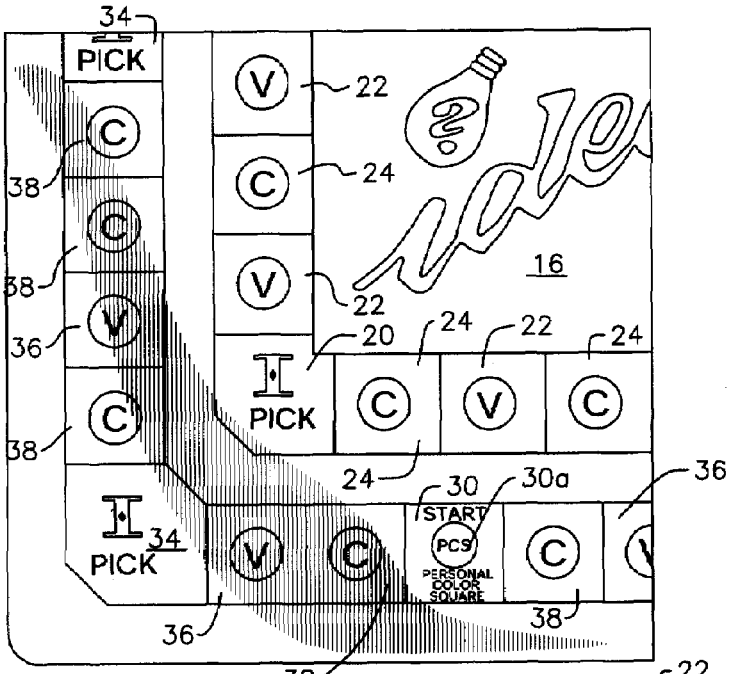
FIG. 4 is a detailed view of the lower left corner of the novel game board.
Figure 6A:
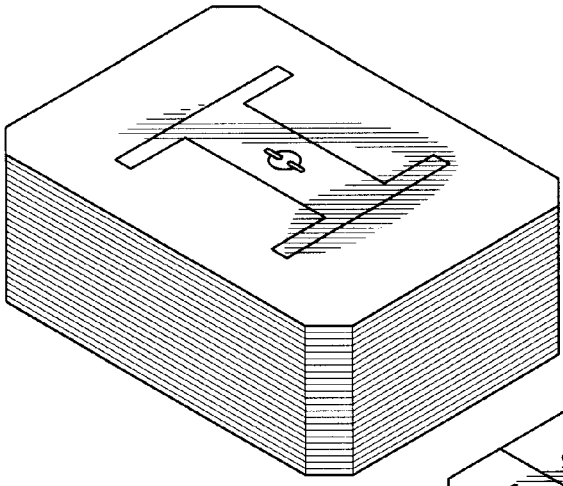
FIG. 6A is a perspective view of a stack of Ideation cards.
Figure 6B:
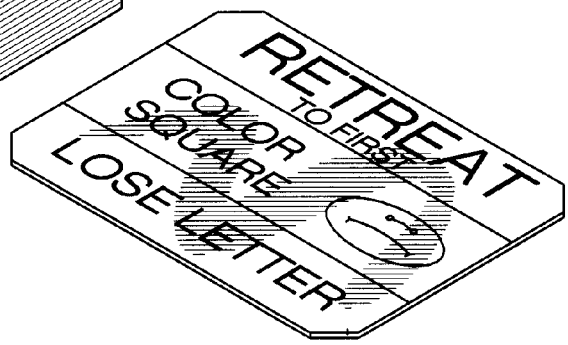
FIG. 6B is a perspective view of a typical Ideation card turned face up.

As best depicted in FIGS. 2 and 3, center area 16 includes stack area 40 that is adapted to hold a stack of "Ideation" cards. The reverse side 41*a* of a stack of said cards is depicted in FIG. 6A and a typical Ideation card is turned face up as at 41*b* in FIG. 6B. In a preferred embodiment of the novel game, sixty (60) Ideation cards are provided.

Center area 16 also includes legend 42 (FIG. 3). Legend 42 includes a "V pick" legend 42*a* which advises players that landing on a "V" square requires them to draw a vowel card from the stack of vowel cards. In a preferred embodiment of the novel game, sixty (60) vowel cards are provided. A stack of such cards is denoted 43 in FIG. 7A.

Legend 42 further includes "C pick" legend 42*b* which advises players that landing on a "C" square requires them to draw a consonant card from the stack of consonant cards. A stack of such consonant cards is denoted 45 in FIG. 7B.

In a preferred, illustrative embodiment of the novel game, two hundred (200) consonant cards 45 are provided. The consonant "Y" is treated as a consonant or a vowel in this game because it may play either role. For example, it is a vowel in English words such as type, pyramid, polygon, etc., and it is a consonant in English words such as yesterday, yield, kayak, etc.

All vowel or consonant cards could be printed on both sides but the same vowel or consonant cannot be printed on both sides. In this way, the drawer of a card cannot know what vowel or consonant is being selected. Such double-sided printing would reduce by half the number of cards needed to play the game.

The game is played with two (2) die, neither of which is conventional. As indicated in FIG. 8, each die has six (6) faces, but two (2) of said faces are blank and only four (4) of said faces have a number thereon. The blank faces are preferably on opposite sides of each die. If a player rolls a 3 and a 2, his or her gamepiece advances five squares just as in a conventional board game. If a player rolls a 3 and a blank, the player advances three squares, i.e., the player's move is the sum of the numbers rolled. However, if a player rolls two blanks, he or she loses a turn. Moreover, numerals are imprinted on the die instead of the conventional dots.

If a player rolls 2 blanks in one roll he loses his turn FIG. 9 depicts an exemplary game piece 44.

The box, not shown, within which the board is packaged is also adapted to hold the cards, die, game pieces, and other unillustrated miscellaneous equipment such as a score pad and pencil, for example.

When a game piece 44 lands on a square at the end of a move, the player associated with that game piece picks a card from the deck of cards designated by that square. The card is placed, face up, on a card support surface, known in this game as a wordgram that is denoted in FIG. 1 by the reference numeral 50.

Figure 7A:
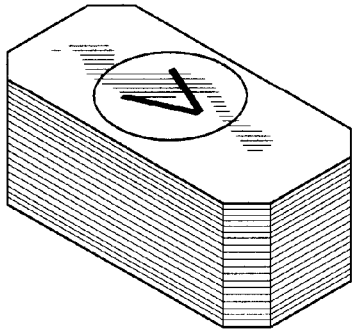
FIG. 7A is a perspective view of a stack of vowel cards.
Figure 7B:
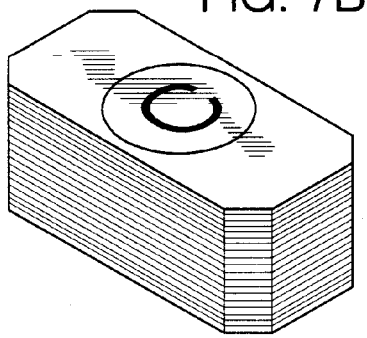
FIG. 7B is a perspective view of a stack of consonant cards.

Specifically, landing on a "V" square requires the player to take the top card from the stack of vowel cards 43. The cards in the stack are face down so only the back of the top card is visible as depicted in FIG. 7A. The drawn card is then deposited, face up, onto the drawing player's wordgram 50.

Landing on a "C" square requires the player to take the top card from the stack of consonant cards 45. The player drawing a consonant card places it, face up, on his or her wordgram 50.

Landing on a Choice of Vowel or Consonant square (also known as the Choice of Deck square 37, as depicted in FIGS. 2 and 5) enables the player to draw a card from either vowel stack 43 or consonant stack 45 and to place the drawn card, face up, on his or her wordgram 50.

Landing on an "Ideation" square requires the player to take the top card from the stack of Ideation cards 41*a* and to follow the instructions thereon.

In a preferred embodiment, the object of the game is to be the first player to form a ten (10) character word on wordgram 50 from the vowels and consonant cards acquired during moves along the set-up walk and the final walk.

The game commences in a conventional fashion. Each player rolls the dice and the player rolling the highest number begins the game, with play moving clockwise around the table.

Each player begins play in the set-up walk on the "Start" square. Each player jumps from the set-up walk to the final walk at his or her designated color-coded Personal Color Square on said final walk upon acquiring five (5) characters. In a first version of the game, if a player ever has less than five (5) characters on his or her wordgram, that player must return to the "Start" square of the set-up walk and progress along the set-up walk until five (5) characters are again acquired at which time a jump is made to that player's Personal Color Square on the final walk. In a second, preferred version, a player who falls below the five (5) character threshold suffers no penalty, i.e., is not required to return to the set-up walk.

As depicted in FIG. 1, wordgram 50 of each player has twelve (12) spaces thereon for holding vowel or consonant cards. If a player has twelve (12) cards on a wordgram during play, and another player lands on a space that requires that other player to draw an "Ideation" card, and where that "Ideation" card requires the moving player to give a card to the player who already has twelve (12) cards on his or her wordgram, then the player with said "full" wordgram is penalized. Specifically, if a player acquires a thirteenth card for any reason, all but five (5) of that player's cards must be removed from the wordgram. The penalized player may select which cards to discard and therefore which cards to retain.

A "round" is defined as a game segment where play comes to an end with no player having formed a ten (10) character word to win the game. Points are awarded to the winner of each round, but if any player forms a ten (10) character word, the game ends and there is no need to assign points.

A round may end when a player forms an eight or nine character word, thereby preventing an opponent from forming a ten (10) character word. Upon forming an eight or nine character word, the player announces "Round over" and that player is awarded points for that round. Specifically, five (5) points are awarded for formation of an eight (8) character word and ten (10) points are awarded for formation of a nine (9) character word.

The winner of a round is also awarded one (1) point for each abandoned card remaining on each opponent's wordgram 50 at the end of the round. When a player announces "Round over," the remaining players attempt to form words that have at least five (5) characters on their respective wordgrams. If one player has nine (9) cards on his or her wordgram when "Round over" is announced, and if that player can form a seven (7) character word from those nine (9) characters, then the winner of the round is awarded an additional two (2) points for the cards not used in formation of said seven (7) character word. The winner of the round acquires points from all of the non-winning players in this way.

However, any abandoned vowel or consonant cards remaining on the wordgram of the round winner costs the round winner one point per abandoned card.

Where only two (2) players are playing the game, only two (2) rounds are played before the point totals of the two rounds are totaled to determine a winner of the game. Three (3) rounds are played if there are three (3) players in the game, and four (4) rounds are played if there are four (4) players.

Points are totaled at the completion of a predetermined number of rounds only if no player wins the game outright by completing a ten (10) character word. This prevents the game from becoming too lengthy in the event the players are unable to form a ten (10) character word within a reasonable time. Non-winning players are never awarded points. Instead, as mentioned above, if they can form a five (5), six (6), or seven (7) character word when "Round over" is announced, the cards remaining on their respective wordgrams that do not form a part of such word are deemed abandoned and one point for each abandoned card on each non-winning player's wordgram is added to the point total of the round winner. Again, abandoned cards in the possession of the round winner are deducted from the round winner's total, one point per abandoned card.

If a player declares "Round over" upon formation of an eight (8) or nine (9) character word and if that word is challenged by an opposing player and that word cannot be found in the pre-approved dictionary that the players have accepted as the authoritative dictionary for that game, then the round continues but the player who pre-maturely announced the end of the round must remove all but five (5) cards from his or her wordgram. For example, if a player announces "Round over" upon completion of the eight (8) character word "calandar," and if an opposing player recognizes the misspelling of said word, challenges it, and proves by using the pre-authorized dictionary that the correct spelling of the word is "calendar," then the player who announced that the round was over must discard all but five (5) of the cards on his or her wordgram. In this example, three (3) cards would have to be discarded. However, the discarding player may choose which cards to discard. Play then resumes as before with the player in the clockwise position to the punished player then taking a turn.

As in Scrabble® and other popular word games, proper names, place names, or hyphenated words are not permitted.

If a player lands on an Ideation square, he or she must draw an Ideation card and follow the instructions thereon. Some ideation cards are helpful, but some are not. For example, if a player draws an Ideation card with the instruction "Go Back" printed thereon, that player must roll both dice and retreat the number of squares represented by the total of the die. Eight (8) is the largest number of squares that a player could possibly have to retreat because four (4) is the highest number on each die. If the game piece lands on a "V," "C," or "Choice of Vowel or Consonant" square at the end of a "Go Back" move, a vowel, a consonant, or either a vowel or consonant card, respectively, of the player's choice must be removed from that player's wordgram and returned to the bottom of the appropriate stack of cards. If a vowel card is drawn and the player has no vowel card, a consonant card is discarded. If a consonant card is drawn and the player has no consonant card, a vowel card is discarded. If a player has no cards to discard, there is no penalty. Nor is there a penalty for landing on any other square at the end of a "Go Back" move.

For example, if the game piece lands on another "Ideation" card square at the end of a "Go Back" move, no "Ideation" card is drawn. In other words, a player can draw only one (1) "Ideation" card per turn.

As a further example, if a player landing on an "Ideation" square draws an "Ideation" card having the word "Trade" imprinted thereon, that player must take one (1) card of his or her choice from his or her wordgram and exchange it with the player sitting to his or her left (the clockwise position). The other player may exchange any card from his or her wordgram, but the players involved in the trade may not simply exchange cards bearing the same character between them. Upon completion of the first trade, the player who drew the "Trade" card must then consummate another trade with the next player, and so on until a trade has been consummated with each opposing player if so required by the drawn card. Some cards may instruct a player to perform only one (1) trade.

A player dissatisfied with his or her cards may trade in one (1), two (2), or three (3) cards when it is his or her turn to play. This trade is not made with another player but is made with the stacks of vowel or consonant cards, or both. For example, a player who wants to get rid of a Q and an E may place the Q at the bottom of the consonant card stack and draw a consonant card from the top of the consonant stack, and repeat that procedure with the E card and the vowel card stack. The player loses his or her turn as the price of the trade.

If a player is required by an Ideation card instruction to give up a vowel but has none, that player must give up a consonant instead, with no penalty. If a player is required to lose a consonant but has none, that player must give up a vowel, with no penalty.

When a game piece lands on a Personal Color Square of an opposing player, that opposing player shall take one card of his or her choice from the wordgram of the player whose game piece landed on said Personal Color Square.

Some of the words employed in this specification that qualify as ten character words include: background, consonants, characters, understand, relatively, vocabulary, collection, nonobvious, embodiment, hyphenated, and particular, to name a few.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A method of playing a board game, comprising the steps of:

providing a set-up walk defining a first path of travel along which respective game pieces controlled by players of said board game advance;

constructing said set-up walk of a plurality of squares where a first plurality of squares represents vowels and a second plurality of squares represents consonants;

providing a plurality of vowel cards and consonant cards;

enabling a player to acquire a vowel card when said player's game piece arrives at an end of a move on a square in said set-up walk representing a vowel;

enabling said player to acquire a consonant card when said player's game piece arrives at an end of a move on a square in said set-up walk representing a consonant;

providing a final walk defining a second path of travel along which said respective game pieces advance;

making said final walk discontinuous from said set-up walk;

constructing said final walk of a plurality of squares where a first plurality of squares represents vowels and a second plurality of squares represents consonants;

enabling a player to acquire a vowel card when said player's game piece arrives at an end of a move on a square in said final walk representing a vowel;

enabling said player to acquire a consonant card when said player's game piece arrives at an end of a move on a square in said final walk representing a consonant;

providing a plurality of separate starting points along said final walk;

identifying each of said starting points as being associated with a particular game piece;

enabling a game piece of a player to exit said set-up walk and to enter said final walk at a starting point on said final walk associated with said player's game piece when said player has accumulated a predetermined number of vowels, consonants, or combinations thereof while advancing along said set-up walk;

providing a wordgram upon which vowel and consonant cards are placed when acquired by a player;

ending said game when a player forms a word consisting of a first predetermined number of vowels and consonants by arranging vowel and consonant cards on said wordgram to spell said word.

2. The method of claim 1, further comprising the steps of:

dividing a game into a predetermined number of rounds prior to commencement of said game;

ending a round when a player forms a word including a second predetermined number of consonants and vowels less than said first predetermined number thereof required to win said game; and awarding to said player forming a word including said second predetermined number of vowels and consonants a first predetermined number of points.

3. The method of claim 2, further comprising the step of:

requiring non-winning players at the end of a round to form a word having at least a predetermined number of characters from the vowels and consonants on their respective wordgrams; and adding to a round winner's point total the number of cards on said non-winning players' respective wordgrams of all opposing players that do not form a part of a word having at least said predetermined number of characters.

4. The method of claim 2, further comprising the step of:

limiting the number of rounds to the number of players of said game.

5. The method of claim 1, further comprising the steps of:

limiting to a predetermined number the total number of vowels and consonants that each player may position upon said wordgram;

penalizing a player having a total number of vowels and consonants that exceeds said predetermined number.

6. The method of claim 5, further comprising the step of:

said step of penalizing a player including the step of requiring said penalized player to discard a predetermined number of vowels and consonants from said wordgram.

7. The method of claim 6, further comprising the step of:

said step of penalizing a player further including the step of requiring said penalized player to lose one turn.

8. The method of claim 1, further comprising the steps of:

pre-approving prior to the playing of said game a dictionary that is consulted in the event the authenticity of a word is challenged during the game;

enabling each player of said game to challenge the authenticity of a word submitted by any player of the game as a game-winning word by demonstrating that the word is either not found in said pre-approved dictionary or, if found, that said word is misspelled;

penalizing a player who submits a game-winning word that is successfully challenged as lacking authenticity by requiring that player to remove a predetermined number of vowels and consonants from that player's wordgram.

9. The method of claim 8, further comprising the step of:

said step of penalizing said player who submits a game-wining word that is successfully challenged further including the step of requiring said penalized player to lose one turn.

10. The method of claim 2, further comprising the steps of:

pre-approving prior to the playing of said game a dictionary that is consulted in the event the authenticity of a word is challenged during the game;

enabling each player of said game to challenge the authenticity of a word submitted by any player of the game as a round-ending word by demonstrating that the word is either not found in said pre-approved dictionary or, if found, that said word is misspelled;

penalizing a player who submits a round-ending word that is successfully challenged as lacking authenticity by requiring that player to remove a predetermined number of vowels and consonants from that player's support surface.

11. The method of claim 10, further comprising the step of:

said step of penalizing said player who submitted a round-ending word that is successfully challenged further including the step of requiring said penalized player to lose one turn.

12. The method of claim 1, further comprising the step of:

penalizing a player whose game piece lands on a square on said final walk that is associated with the game piece of another player.

13. The method of claim 12, further comprising the step of:

penalizing the player whose game piece lands on a square of said final walk associated with the game piece of another player by causing said penalized player to lose a vowel or a consonant in the possession of said penalized player to said player with whom said square is associated, said player being the beneficiary of the penalty.

14. The method of claim 13, further comprising the step of:

enabling the player with whom said square is associated to choose which of said vowels or consonants in the possession of the penalized player is to be acquired by said beneficiary of said penalty.

15. The method of claim 1, further comprising the steps of:

including in said final walk at least one square representing either a vowel or a consonant; and enabling said player to acquire a vowel or a consonant at the election of said player when said player's game piece arrives at the end of a move on a square representing either a vowel or a consonant.

16. The method of claim 3, further comprising the steps of:

deducting one point from the round winner's point total for each card on said round winner's wordgram that does not form a part of the word formed by said round winner to end said round.

17. The method of claim 16, further comprising the step of:

requiring a player to discard a vowel, consonant, or choice thereof if a player is required to move said player's gamepiece backwards and if said backward-moving gamepiece lands on a vowel, consonant, or choice of vowel or consonant square, respectively.

18. The method of claim 17, further comprising the steps of:

enabling a player lacking a vowel to discard a consonant upon being required to discard a vowel;

enabling a player lacking a consonant to discard a vowel upon being required to discard a consonant.

* * * * *